US005448855A

United States Patent [19]

Sjöholm

[11] Patent Number: 5,448,855

[45] Date of Patent: Sep. 12, 1995

[54] SLIDING ELEMENT SYSTEM

[76] Inventor: Jarmo Sjöholm, Hovitie 20, Vanata, Finland, SF-01380

[21] Appl. No.: 122,437

[22] PCT Filed: Mar. 26, 1992

[86] PCT No.: PCT/FI92/00089

§ 371 Date: Sep. 22, 1993

§ 102(e) Date: Sep. 22, 1993

[87] PCT Pub. No.: WO92/17673

PCT Pub. Date: Oct. 15, 1992

[30] Foreign Application Priority Data

Mar. 27, 1991 [FI] Finland ..... 911478
Oct. 29, 1991 [FI] Finland ..... 915101

[51] Int. Cl.[6] ..... E05D 15/26
[52] U.S. Cl. ..... 49/125; 160/201
[58] Field of Search ..... 160/201, 196.1, 202, 160/199; 49/125, 126, 127, 128

[56] References Cited

U.S. PATENT DOCUMENTS

| | | | |
|---|---|---|---|
| 3,042,960 | 7/1962 | Spork | 160/199 X |
| 3,693,293 | 9/1972 | Egan et al. | 49/125 X |
| 3,990,183 | 11/1976 | Meggs et al. | 49/125 |
| 4,388,778 | 6/1983 | Brooke | 49/125 |
| 4,991,257 | 2/1991 | Eutebach | 160/196.1 X |

FOREIGN PATENT DOCUMENTS

| | | |
|---|---|---|
| 0437029 | 7/1991 | European Pat. Off. . |
| 906331 | 6/1991 | Finland . |
| 84645 | 9/1991 | Finland . |
| 2557624 | 7/1985 | France . |
| 2651529 | 3/1991 | France . |
| 964030 | 5/1957 | Germany . |
| 1584010 | 1/1970 | Germany . |
| 155195 | 2/1989 | Germany . |
| 98855 | 5/1940 | Sweden . |
| 7811188 | 4/1983 | Sweden . |
| 542982 | 11/1973 | Switzerland . |
| 8909320 | 10/1989 | WIPO . |
| 9012188 | 10/1990 | WIPO . |

*Primary Examiner*—David M. Purol
*Attorney, Agent, or Firm*—Merchant & Gould, Smith, Edell, Welter & Schmidt

[57] ABSTRACT

A sliding element system has a rectangular sliding element (1) with a first side (2) and a second side (3), these sides being substantially parallel to each other; guide wheel sets (4, 5) which are attached on the first side (2) and the second side (3) of the sliding element, each such guide wheel set (4, 5) having a number of wheels (6, 7, 8) and an axle (9) on which the wheels are rotatably carried one after the other to be separately rotatable, and the axle being fixed at right angles to the first and/or, respectively, the second side of the sliding element; a stationary pair of guide sections (10, 11) has a first guide section (10) located on the side of the sliding element's first side (2) and a second guide section (11) located on the side of the sliding element's second side (3), and the guide section (10, 11) has supports (12, 13, 14) running parallel with the guide section, for guiding and carrying the guide wheel sets, of which at least one first support (12) is in contact on one side of the first wheel (6) and a second support (13) is in contact on the opposite side of the second wheel (7) relative to the contact of the first wheel and the first support. The wheels (6, 7, 8) of each guide wheel set (4, 5) together with the coordinated supports (12, 13, 14) are disposed to retain and to carry the sliding element (1) in all directions except the direction of movement defined by the guide sections (10, 11) and the supports.

13 Claims, 3 Drawing Sheets

Fig. 11
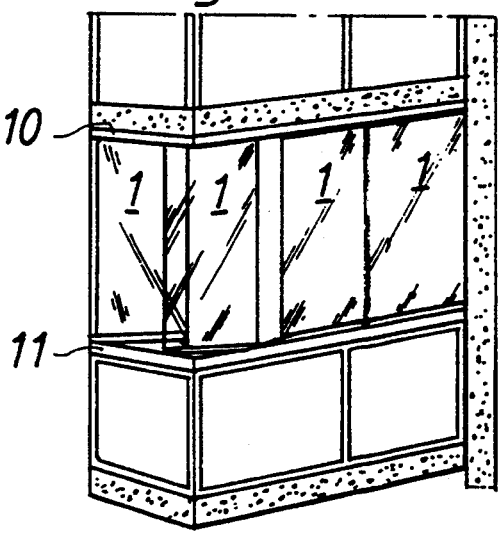
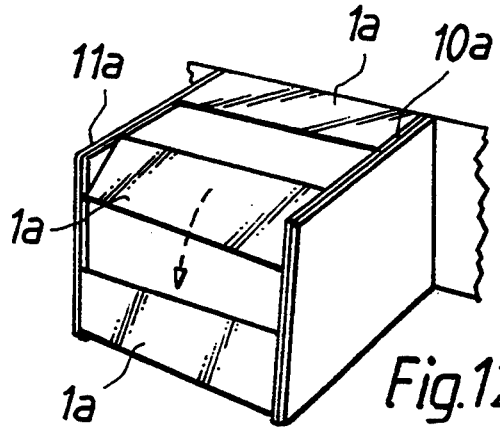
Fig. 12
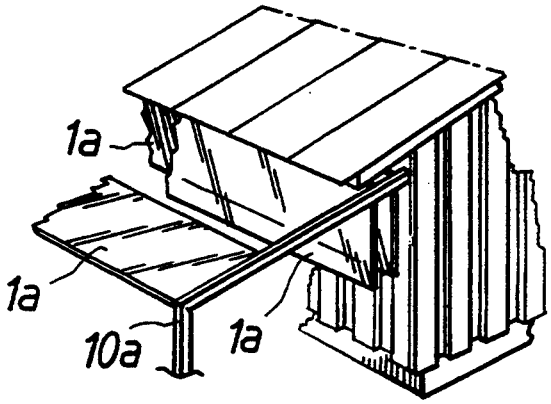
Fig. 13
Fig. 16
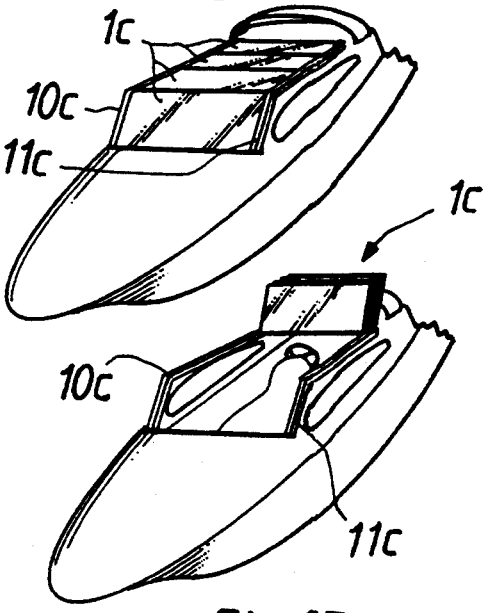
Fig. 17
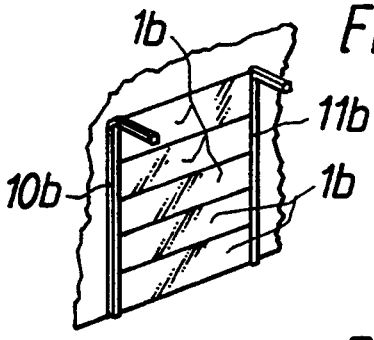
Fig. 14
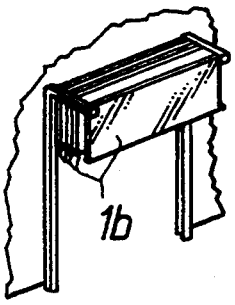
Fig. 15

SLIDING ELEMENT SYSTEM

BACKGROUND OF THE INVENTION

1. Field of the Invention

The invention concerns a sliding element system.

2. Description of the Prior Art

In prior art are known, e.g. through the references DE 155 195 and SE 427 683, sliding element systems in which the elements are movable partitions. A typical system of this category comprises a rectangular sliding element which has been installed with the aid of guide wheel sets, to be carried, and movable, on a guide section. In both references of prior art, the set of guide wheels comprises a plurality of wheels and an axle on which said wheels are rotatably carried one after the other to rotate separately, and said axle being affixed at right angles to a first and/or, respectively, a second side of the sliding element. The guide section is fixedly mounted on the structures of a building. The guide section, of box type, comprises planar carrying surfaces which are longitudinal thereto and in support of which the guide wheel sets are carried. Said carrying surfaces are alternatingly in contact with wheels located one above the other in such manner that one carrying surface supports one side of one wheel in the guide wheel set, while the other carrying surface supports the opposite side of the other wheel. With an arrangement like this the advantage is gained that the guide section can have angles through which the wheel sets of the sliding element can be conveyed without difficulty.

However, the problem with these systems known in the art is that they are only applicable in vertical installation because the carrying surfaces are arranged to give support to the wheels in the vertical direction only.

It is a further problem in the case of systems known in the art, that they are not applicable in instances where the sliding elements are subject to dynamic, variable load in a direction perpendicular against the sliding element. Such a loading case is for instance encountered in connection with so-called balcony glass enclosure systems, in which case the sliding elements, or glass elements, are subject to variable loads owing to wind pressure, which also gives rise to objectionable noise as the glass elements vibrate and clatter against the guide sections.

The object of the invention is to eliminate the drawbacks mentioned in the foregoing.

In particular, the object of the invention is to provide a sliding element system which can be installed, without changing any components, in any desired position and which at the same time affords the advantage that the guide section may have angles through which the wheel sets of the sliding element can be conveyed without difficulty, in order that the sliding element might be conveyable through any angles in the guide section.

It is a further object of the invention to provide a sliding element system which can be made completely sturdy and noiseless in spite of lateral loads acting on the sliding elements, e.g. of varying loads to which they are subjected owing to wind pressure.

SUMMARY OF THE INVENTION

As taught by the invention, the wheels of each guide wheel set have been arranged, together with the respective supports, to retain and carry the sliding element in all directions except in the direction of movement defined by the guide section and the supports.

The sliding element system can be installed in any position because the supports carry and brace the guide wheel sets in all directions except in the direction of movement, without interfering in any way with the function of the system. A sliding element is understood to mean any structural element whatsoever which has been disposed to be movable, carried on guide sections. The sliding elements may be mounted in upright position, in horizontal position or in any position whatsoever, and the sliding of the sliding elements may be in vertical or horizontal direction, or in any other direction, depending on the application. The sliding elements are always carried with equal firmness by the guide sections, independent of position. One particular application consists of balcony glassing-in systems, in which a balcony is isolated from outdoor air by means of movable, and openable, glass elements.

In an embodiment of the system, the support comprises a channel-like groove, the cross section configuration of this groove and the cross section configuration of the contact surface of the periphery of the wheel cooperating therewith being arranged to conform substantially to each other.

In an embodiment of the system, the cross section configuration of the groove in the support is concavely round. The cross section of the contact surface of the periphery of the wheel which is in contact with the groove is convexly round and fitted to fit in the groove with a certain amount of play. The walls of the channel-like groove extend to encircle the periphery of the wheel at the point of contact over the whole point of contact between them, and they extend to the side of the wheel on both sides. The round exterior shape of the wheels is advantageous particularly in those sliding element systems, e.g. in balcony glassing-in systems, where the guide wheel sets have to be touched with the hand when the elements are being installed and when they are being opened. Touching wheels with a round shape is then experienced as more pleasant.

In an embodiment of the system, the wheel comprises a channel-like groove, its cross section configuration and the cross section configuration of the support cooperating therewith being arranged to conform substantially to each other. In that case, the channel-like groove of the wheel encircles the support.

In an embodiment of the system, the cross section configuration of the wheel's channel-like groove is concavely round. The cross section configuration of the support in contact with the groove is convexly round and fitted to fit in the groove of the wheel with appropriate play.

In an embodiment of the system, the support comprises at least two surfaces forming an angle with each other. The contact surface of the wheel has a corresponding angular configuration.

In an embodiment of the system, the support is a flange-like rib which is perpendicular against the axle. The wheel comprises two flanges and between them a groove which is fitted to receive said rib in itself.

In an embodiment of the system, to either side of the sliding element are attached, spaced from each other, two guide wheel sets, a first guide wheel set and a second guide wheel set, in such manner that one guide wheel set on either side is in register with its counterpart and that the guide wheel sets on one and the same side cooperate with one and the same guide section. To the first guide wheel set belongs a smaller number of wheels than to the second guide wheel set. The axle of the first guide wheel set is shorter than that of the second guide wheel set. The guide sections are box-type sections, open on one side. The walls of the guide sections comprise apertures which are in register in both guide sections and which are so disposed that the guide wheel sets are easily removable through the aperture and released from guidance by the guide sections. Installation of the sliding elements will then be easy. The system furthermore comprises a cover with which the aperture in the wall of the guide section can be partly covered so that when this cover has been installed to constitute a partial cover of the aperture the outermost wheel on the axle of the second guide wheel set will be supported by said cover as the second guide wheel set is moved past the aperture, within the guide section. When the first wheel set is similarly positioned in register with the aperture, the first wheel set can be removed through the aperture unhindered by the cover, in order that the sliding element can be turned so that the axle of the second guide wheel set acts as pivot axle around which the turning takes place.

In an embodiment of the system, the first guide wheel set comprises at least two wheels, and the second guide wheel set comprises at least one wheel more than the first guide wheel set.

In an embodiment of the system, the cover is made of elastic material, such as plastic, and holding elements have been formed thereon, which are integral with the cover, for attaching the cover to the rim of the aperture. A cover like this is easy to remove, and to affix, without tools.

In the following the invention is described in detail, referring to the attached drawing, wherein:

BRIEF DESCRIPTION OF THE DRAWINGS

FIG. 11 presents the sliding element system in use as an enclosure for a balcony enclosure. FIGS. 12 and 13 present the sliding element system of the invention in use with a roof system. FIGS. 14 and 15 present the sliding element system of the invention in use as a sliding door; and FIGS. 16 and 17 present the sliding element system of the invention in use as an enclosure for the passenger compartment of a boat.

DETAILED DESCRIPTION OF THE DRAWINGS

FIGS. 1, 2 and 7–10 present one and the same embodiment according to the invention of the sliding element system, depicted in various sections and viewed from various directions.

Figure 1:
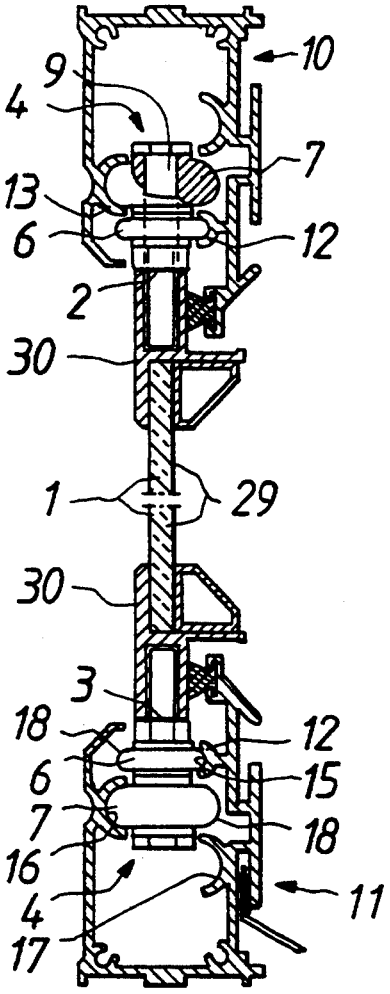
FIG. 1 presents an embodiment of the sliding element system of the invention, installed to be carried by guide sections, and vertically sectioned through the location of the first guide wheel set.

In FIG. 1 is depicted a vertical cross section of an embodiment of the sliding element system, in which the sliding element system is a balcony glassing-in system. The sliding element 1 comprises here a hardened glass sheet 29. Laminated glass sheets are equally applicable as glass elements in a balcony glassing-in system. The sliding element system comprises advantageously a plurality of consecutive sliding elements 1, although in FIGS. 1–9 only the arrangement of one such sliding element 1 has been considered.

The sliding element 1 is rectangular in shape, whereby it comprises a first side 2 and a second side 3, parallel to each other. The first side 2 of the sliding element 1 is in this application its top side, and the second side is its bottom side, as can be seen in FIGS. 1, 3, 7 and 8. The margins of the glass sheet 29 adjacent to the first side 2 and to the second side 3, that is the top margin and the bottom margin, are fixed in elongated frame sections 30, which extend the length of the margin of the glass sheet 29. The frame sections 30 are more closely discussed in the foregoing, referring to FIG. 9.

Figure 2:
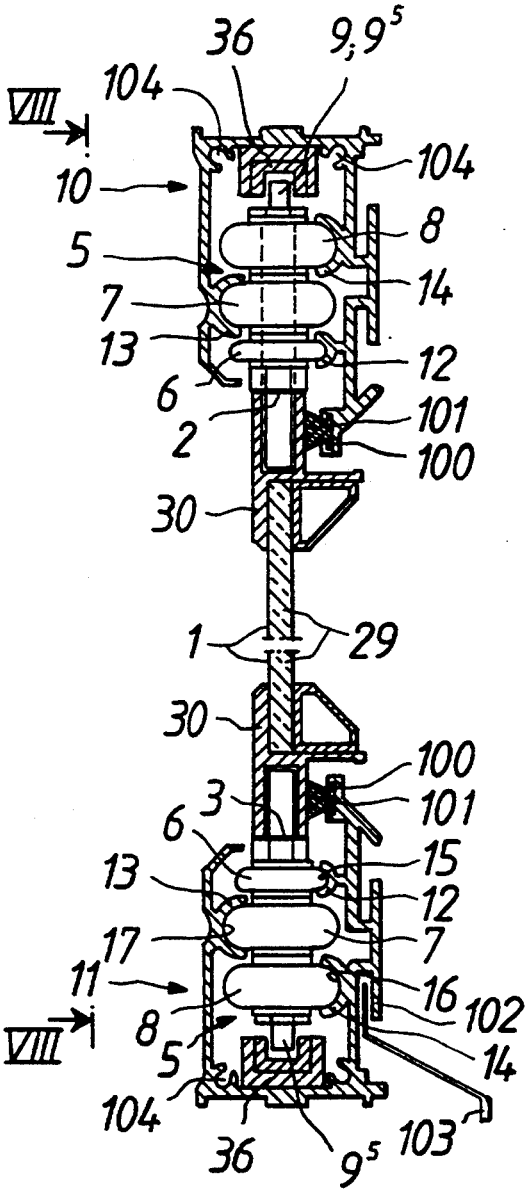
FIG. 2 presents the corresponding section of the system of FIG. 1, at the location of the second guide wheel set.

To the first side 2 and the second side 3 of the sliding element 1 are attached guide wheel sets 4. In FIG. 1, two such guide wheel sets 4 can be seen, which are located at the same point of the sliding element 1 on its top and bottom sides. The guide wheel set 4 comprises, here, two wheels, 6 and 7. The wheels 6 and 7 are rotatably carried one after the other and concentrically on the axle 9 in such manner that they can rotate freely, independent of each other. In FIG. 2, there has been attached to the same sliding element 1 as in FIG. 1, but at a distance from the first guide wheel set 4, advantageously in the vicinity of the corners of the sliding element 1 and on both sides 2 and 3, a second guide wheel set 5 (see also in combination FIGS. 7 and 8). This second guide wheel set 5 comprises three wheels 6, 7 and 8. The wheels 6, 7 and 8 are rotatably carried one after the other, concentrically, on a straight axle 9 in such manner that the wheels can rotate freely, separate from each other independently, and that wheels which are one over the other can rotate in different directions. The axle 9 is a straight bolt attached with screw juncture directly to the frame section 30, in a line with the glass sheet 29. Thereby the weight of the glass sheet 29 only causes a tension load on the axle 9, not any bending load.

The rotatable mounting of the wheels 6, 7 and 8 on the axle 9 has been disposed so that the wheels are between the mating surfaces on the sides there is a friction-reducing, smooth bearing plate, which is made of non-rusting material. The wheels 6, 7 and 8 consist advantageously of plastic material, e.g. POM die-cast plastic wheels.

The system further comprises a guide section pair 10,11. The guide sections 10 and 11 are fixedly mounted on a stationary structure. The first guide section 20 is on the side of the first side 2 of the sliding element 1, and the second guide section 11 is on the side of the second side 3 of the sliding element 1. The guide sections 10 and 11 are identical, box-type sections, advantageously made of aluminium in conventional manner by extrusion. To the guide sections 10 and 11 belong supports 12, 13, 14 parallelling the guide sections, these supports serving to carry and guide the guide wheel sets 4 and 5. In FIG. 1, the guide wheel set 4 provided with two wheels is held in support of the guide section 10,11 by resting against two supports 12 and 13, which are located inside the guide section 10,11. The first wheel 6 rests against the first support 12, and the second wheel 7 rests against the second support 13. The guide section 10,11 also contains a third support 14, intended for the third wheel 8 of a three-wheeled guide wheel set 5, as in FIG. 2. The supports coordinated with wheels located one above the other support the different wheels in diametral alternation on opposite sides, whereby the guide wheel sets 4 and 5 are firmly held by the guide sections 10 and 11. The wheels 6,7,8 of each guide wheel set 4 in cooperation with the respective supports 12,13,14 have been disposed to retain and support the sliding element 1 in all directions except in the direction of movement defined by the guide sections 10,11 and the supports. In other words, the sliding element 1 can move in the direction of the guide sections 10 and 11 only. The guide wheel sets 4 and 5 cannot move in the direction of the axle 9. Loads which are perpendicular against the sliding element 1, e.g. the wind forces in the case of glassed-in balconies, do not in any way impede the travelling of the sliding elements in support of the guide sections, and fluctuating load like wind load causes no loud vibration. The system works as well when loaded as it does under load in any direction, independent of whether the system has been installed in the horizontal or vertical plane or at an inclination.

The guide sections 10 and 11 may be shaped to be provided with various flanges and grooves for various purposes. The guide section 10,11 comprises a groove 100 for a brush seal 101, and a mounting flange 102 for a dripping plate 103. In the inside corners of the guide section 10,11 fixing grooves 104 have been formed by the aid of which, with simultaneous use of suitable installation members such as pins, screws etc. such sections can be attached to each other end to end straight, as well as mitre joints can be made.

It is seen in FIG. 1 that in the exemplary case the supports 12, 13 and 14 comprise channel-like grooves 15, 16 and 17. The cross section of the grooves 15, 16 and 17 reveals that each groove has a concavely round shape. Correspondingly, the cross section configuration of the periphery of the contact surface 19 of the wheels 5, 7 and 8 which are in rolling contact with a groove is convexly round and fits into the respective groove. The walls of the channel-like groove extend to encircle the periphery of the wheel at the point of contact, over the point of contact between them, and they extend onto the sides of the wheel on either side. The shape of the grooves is also advantageous in view of cleanliness because dirt and foreign bodies cannot accumulate in the grooves, an event which could hamper the cooperation of the guide wheel sets and grooves.

With appropriate regulation of the spacing of the guide sections 10,11 the weight of the element 1 can be distributed on all wheels 6,7,8 on either side 2 and 3, and similarly on all supports 12,13,14 of the guide sections 10 and 11.

In FIGS. 3–6 are depicted a few alternative examples of the embodiment of FIGS. 1 and 2 regarding ways in which the wheels 6,7,8 and the corresponding supports 12,13,14 of the sections can be configurated in order that the aim of the invention might be achieved. FIGS. 3–6 show in each case, schematically, only one wheel in elevational view, detached from the system entity.

Figure 3:
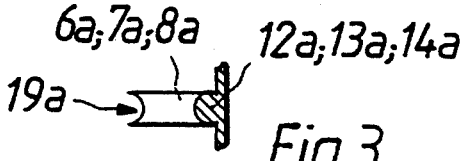
FIGS. 3–6 present, schematically four embodiments differing with regard to the wheel and support configurations.

In FIG. 3, the wheel **6*a*, 7*a*, 8*a* comprises a groove 19*a*, its cross section configuration, and that of the cooperating support 12,13,14, being arranged to conform substantially to each other in that the cross section configuration of the wheel 6*a*, 7*a*, 8*a* is concavely round and the cross section configuration of the support 12*a*, 13*a*, 14*a*** in contact with it is convexly round and has been fitted to fit into the groove on the wheel with a certain amount of play.

Figure 4:
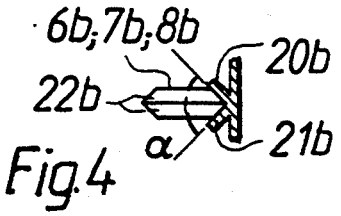

In FIG. 4, the support **12*b*, 13*b*, 14*b* comprises two surfaces 20*b* and 21*b* which form an angle $\alpha$ with each other. The contact surface 22*b* of the wheel 6*b*, 7*b*, 8*b* has a corresponding angular shape. The contact surfaces 20*b* and 21*b* of the support 12*b*, 13*c*, 14*c*** open here in V fashion in the inward direction of the section.

Figure 5:
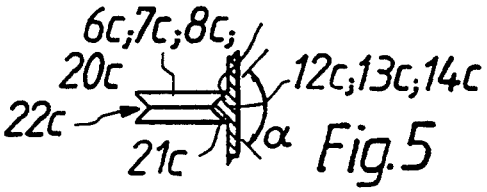

In FIG. 5, the support **12*b*, 13*b*, 14*c* comprises two surfaces 20*c* and 21*c* which form an angle $\alpha$ with each other. The contact surface 22*c* of the wheel 6*c*, 7*c*, 8*c* has a corresponding angular shape. The contact surfaces 20*c* and 21*c* of the support 12*c*, 13*c*, 14*c*** are in cross section the sides of a wedge-like flange.

Figure 6:
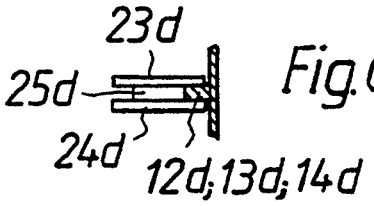

In FIG. 6, the support **12*d*, 13*d*, 14*d* is a flange-like rib projecting at right angles from the wall of the section. The wheel 6*d*, 7*d*, 8*d* comprises two flanges 23*d*, 24*d* a gap 25** between them which is arranged to receive the rib.

Figure 7:
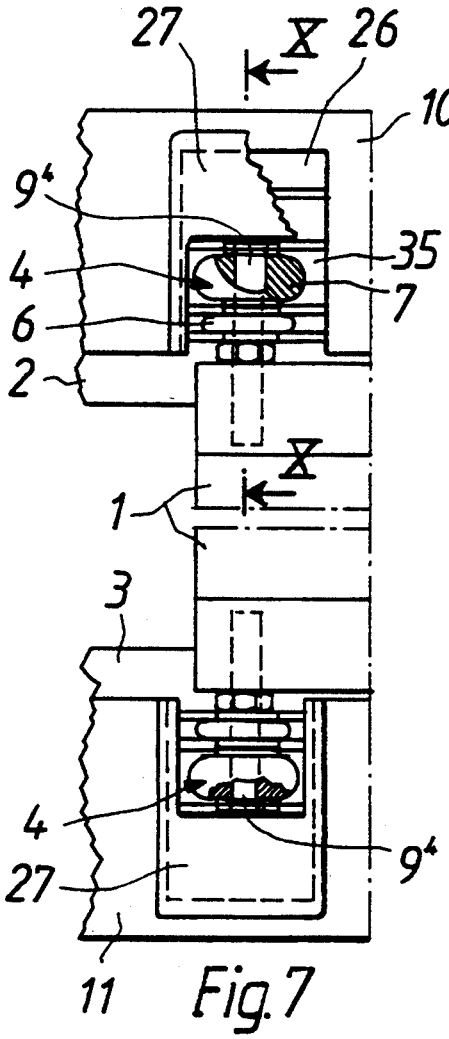
FIG. 7 presents the system of FIGS. 1 and 2 as seen when the first guide wheel set is in register with the aperture in the walls of the guide sections.
Figure 8:
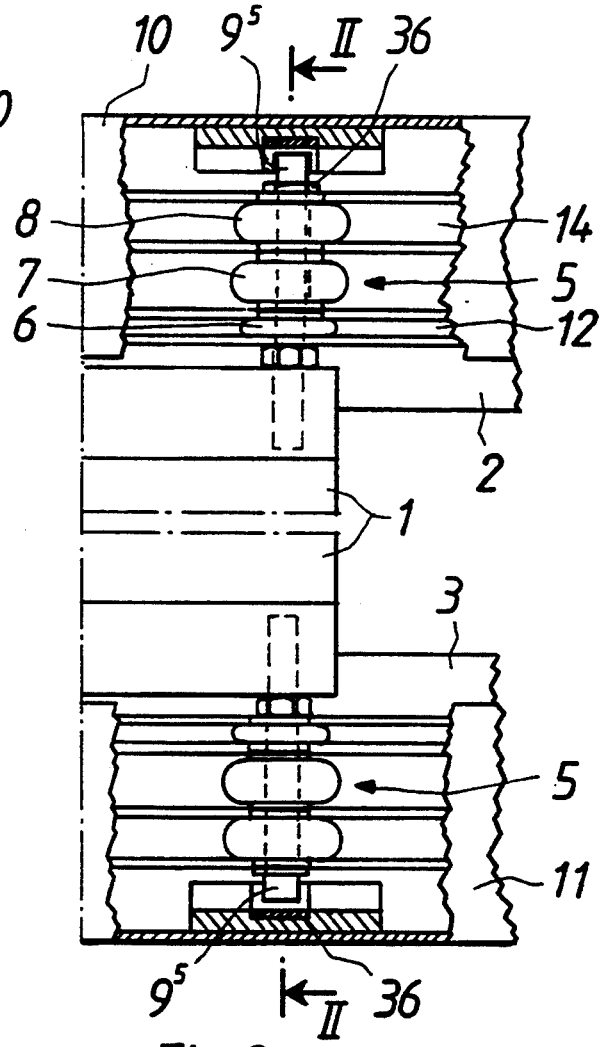
FIG. 8 presents the system of FIGS. 1, 2 and 7 as seen when the second guide wheel set is at the hinge point.

In FIGS. 7 and 8 is depicted the same sliding element 1, to both sides 2,3 of which have been attached, spaced from each other, two guide wheel sets, a first guide wheel set 4 and a second guide wheel set 5. The first guide wheel sets 4 are located on both sides 2 and 3 in register with each other, as can also be seen in FIG. 1. Similarly, the second guide wheel sets 5 are located on both sides 2 and 3 in register with each other, as can also be seen in FIG. 2. The guide wheel sets 4 and 5 attached to the first side 2 with axles 9 operate in guidance of one and the same guide section 10, and similarly the guide wheel sets 4 and 5 attached to the second side 3 with axles 9 operate in guidance of one and the same guide section 11. As has been said before, the first guide wheel set 4 comprises two wheels and the second guide wheel set 5, three wheels, and the axle $9^4$ of the first guide wheel set is shorter than the axle $9^5$ of the second guide wheel set. Therefore the extension of the first guide wheel set 4 is lower than that of the second guide wheel set 5. The walls of the box-type guide sections 10 and 11 comprise apertures 26, in register with each other in both guide sections 10 and 11 and so disposed that the first guide wheel set 4 as well as the second guide wheel set 5 can be removed through the aperture 26, out of guidance by the guide sections; this facilitates the installation of the sliding elements 1 to be carried by the guide sections 10 and 11. The aperture 26 is thereafter covered with a cover 27, visible in FIGS. 7, 9 and 10. The cover 27 is held against the rim of the aperture 26 by means of retaining members 28, shaped on the cover and constituting an integral body with the cover. The purpose of the cover 27 is to cover the aperture 26 partially, and to this end the cover comprises a second aperture 35, which admits the two-wheeled first guide wheel set 4 to come out when the sliding element 1 has been moved into a position in which the first guide wheel set 4 is in register with the apertures 26 in the guide sections, as is the case in the situation depicted in FIGS. 7 and 10. Simultaneously, the three-wheeled second guide wheel set 5 is located at the hinge point advantageously determined by the hinge arrangement 36, where the axle $9^5$ of the guide wheel set 5 becomes locked to be stationary relative to the guide sections 10,11 when one starts to turn the sliding element 1 with the axles $9^5$ serving as hinge pins about which the sliding element 1 turns. Said hinge arrangement 36 is advantageously of the kind described in the same applicant's Finnish patent application FI-914848, which is cited here.

Figure 9:
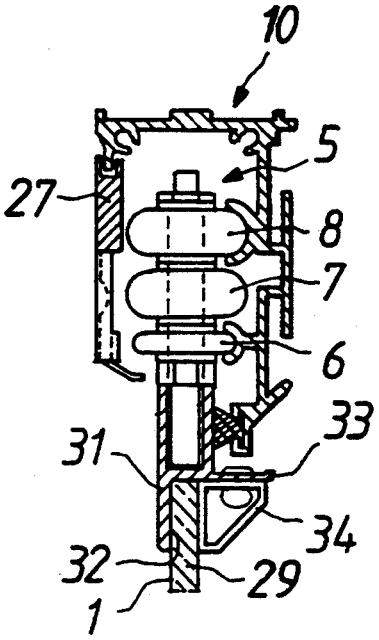
FIG. 9 presents, in vertical section, the system of FIGS. 1, 2, 7 and 8 in a situation in which the second guide wheel set is in register with the aperture in the wall of the guide section.
Figure 10:
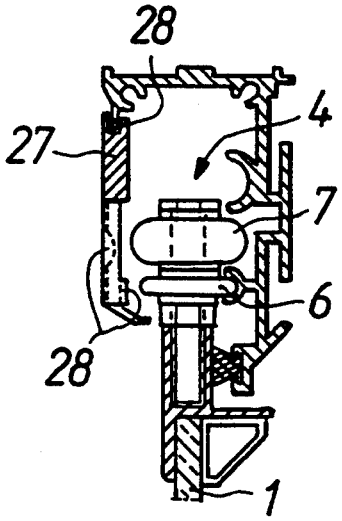
FIG. 10 presents, in vertical section, the system of FIGS. 1, 2, and 7–9 in a situation in which the first guide wheel set is in register with the aperture in the wall of the guide section.

It is evident from FIG. 9 that when the cover 27 has been installed in the aperture 26, the third wheel 8 in extreme position on the axle $9^5$ of the second guide wheel set rests against the cover 27 in order that the second guide wheel set 5, which is not meant in normal use to emerge through the aperture 26, could be moved past the aperture 26 without its inadvertent emergence through the aperture.

In FIG. 8 is also shown an advantageous configuration of the frame section 30. The frame section 30 is a section advantageously made of aluminium by a conventional extruding process. The configuration of the frame section 30 here presented has the advantageous feature that the thickness of the glass to be mounted in this frame section can be selected as required in each instance. In order to enable this, the frame section 30 comprises a first flange 31 presenting an abutment surface 32 parallelling the glass sheet 29 which is to be mounted, and against which the marginal area of the glass sheet abuts on one side. The frame section 30 further comprises a second flange 33 perpendicular against the first flange 31. The frame section is mounted on the glass sheet 29 in that a separate glazier's bar section with triangular cross section, 34, having two outer surfaces at right angles to each other is placed against the glass sheet, and against the second flange 33, and secured in place to the second flange 33, whereby the glass sheet is held in the slot between the first flange 31 and the glazier's bar section 34. The glazier's bar section 34 shown in FIG. 9 is a box-type section made of aluminium by extrusion. The section 34 can advantageously be attached to the glass sheet by cementing and to the second flange by cementing and/or riveting, e.g. with pop rivets. The second flange 33 of the frame section 30 is so disposed that it is possible, by displacing the position, and attachment, of the glazier's bar section 34 relative to the second flange 33, to mount glass panes, or multiply glass sheets, of different thicknesses in this frame section. It is also easy to replace the pane when required.

In FIG. 11 is depicted an application of the sliding element system of the invention in which the sliding elements 1 belonging to the system are glass elements protecting and isolating a balcony and which are carried by horizontal guide sections 10 and 11. The first, or top, guide section 10 is affixed to the floor slab of the balcony above. The second, or bottom, guide section 11 is affixed to the railing of the balcony below. The guide sections 10,11 are angulated at the corner of the balcony. Since the guide wheel sets have been disposed on the elements as described in the foregoing, for instance as in FIGS. 1–10, the glass elements can be conveyed through the angulation without difficulty, and opened at any desired point. The running of the elements 1 is convenient, and they are firmly carried and held by the guide sections in the manner taught by the invention.

FIGS. 12 and 13 present applications of the invention in which the sliding element system constitutes a translucent roof system, in which the guide sections **10*a* and 11*a* have been installed partly in vertical and partly in inclined position and the glass elements 1*a* can be moved, and opened, with the aid of the design described in connection with FIGS. 7 and 8. The glass elements 1*a* can be lowered down along the sections, or they can be bunched under the eaves, as in FIG. 13**, when it is desired to put the panes aside.

In FIGS. 14 and 15 is depicted an application of the invention in which the sliding element system constitutes a sliding door consisting of a plurality of sliding door elements **1*b*. The guides 10*b* and 11*b* comprise a vertical part and a horizontal part, the latter at right angles against the vertical part and extending from the top end of the vertical part a certain distance horizontally into the building. When this door is opened, the sliding door elements 1*b* may be bunched, as shown in FIG. 15**, to hang side by side, suspended from the horizontal part of the guide sections.

In FIGS. 16 and 17 one more application is shown, in which a sliding element system according to the invention constitutes the sliding cover of a boat, by the aid of which an enclosed boat can be converted into an open boat by sliding the windshield and roof elements **1*c* along the guide sections 10*c* and 11*c*** into the stern region of the boat's roof.

In connection with FIGS. 1–17 merely some examples of sliding element systems have been described. In actual fact, nothing but the designer's fantasy imposes limits on the range of objects in which it is advantageous to apply the sliding element system of the invention.

A system according to the invention, similar in principle, and identical components, enable the greatest variety of sliding element systems to be implemented, in which the position of the elements and the direction in which they move have no influence on the functioning of the system. The sliding elements may be windows, doors, glass doors, panel doors, shower walls, walls, partition panels, ceiling/roof elements, shelter roofs, hatches, etc. Various applications may be found in residential and industrial buildings, land vehicles and water conveyances.

The invention is not delimited merely to concern the embodiment examples presented in the foregoing; numerous modifications are feasible while staying within the scope of the inventive idea defined by the claims.

I claim:

1. A sliding element system comprising:

a rectangular sliding element having a first side and a second side substantially parallel to each other;

a plurality of first guide wheel sets and second guide wheel sets operatively connected on the first side and the second side of the sliding element, each of said guide wheel sets comprising a plurality of wheels, said wheels rotatably mounted on an axle, said axle being fixed at substantially right angles to the first and the second side of the sliding element, said wheels rotating substantially perpendicular to the plane of said sliding element;

a stationary pair of guide sections comprising; a first guide section on the first side of the sliding element and a second guide section on the second side of the sliding element, first and second supports on each guide section for guiding and carrying the guide wheel sets, said first support in contact with at least a portion of the first wheel and a second support in contact with at least a portion of the second wheel, whereby each of the first and second supports including a groove adapted to receive at least a portion of the wheel, whereby the wheels of each guide wheel set together with the first and second supports are disposed to retain and to carry the sliding element in all directions except the direction of movement defined by the first and second guide sections and the first and second supports.

2. The system of claim 1, wherein each of the grooves of the first and second supports are concavely round and the portions of the wheels received in the grooves are convexly round for fitting within the grooves.

3. The system of claim 1, wherein the support additionally comprises at least two surfaces which form an angle with each other for receiving a correspondingly configured portion of a wheel.

4. The system of claim 1, wherein the support is a flange-like rib which is at right angles to the axle; and the wheels include two flanges with slots between them, the slots disposed to receive the rib.

5. The system of claim 1 further including a plurality of first and second guide wheel sets, wherein the first guide wheel sets and the second guide wheel sets are in register with each other and the guide wheel sets cooperate with each other, the first guide wheel sets including a smaller number of wheels than the second guide wheel sets, and the axle of the first guide wheel sets is shorter than the axle of the second guide wheel sets, the guide sections and their walls comprise apertures which are in register on both guide sections and are so disposed that the first and second guide wheel sets are removable through said aperture; the system additionally including a cover by which the aperture is partly coverable, whereby when the cover constitutes a partial covering of the aperture, the wheels in the extreme positions on the axle of the second guide wheel sets rest against said cover as the second guide wheel sets are being moved past the aperture and when the first guide wheel sets are in register with the aperture, the first guide wheel sets can be removed through the aperture without hindrance from the cover, for turning the sliding element.

6. The system of claim 5, wherein the first guide wheel sets include at least two wheels and the second guide wheel sets include at least one wheel more than the first guide wheel sets.

7. The system of claim 6, wherein the cover is formed of elastic material, and includes holding members for securing the cover over the aperture.

8. A sliding element system comprising:

a rectangular sliding element having a first side and a second side substantially parallel to each other;

guide wheel sets operatively connected to the first side and the second side of the sliding element, each of said guide wheel sets comprising a plurality of wheels, the wheels rotatably mounted on an axle, said axle being fixed at substantially right angles to the first side and the second side of the sliding element, said wheels rotating substantially perpendicular to the plane of the sliding element;

a stationary pair of guide sections comprising, a first guide section on the first side of the sliding element and a second guide section on the second side of the sliding element, first and second supports on each of the first and second guide sections for guiding and carrying the wheels of the guide wheel sets, the first support in contact with at least a portion of the first wheel and a second support in contact with at least a portion of the second wheel;

each of the wheels including a groove adapted to receive at least a portion of the first and second supports.

9. The system of claim 8 wherein each of the grooves of the wheels is concavely round and the support cooperating with each of the grooves is convexly round and is adapted to fit into the grooves.

10. The system of claim 8, wherein the support additionally comprises at least two surfaces which form an angle with each other for receiving a correspondingly configured portion of a wheel.

11. The system of claim 8, further including a plurality of first and second guide wheel sets, wherein the first guide wheel sets and the second guide wheel sets are in register with each other and the guide wheel sets cooperate with each other, the first guide wheel sets including a smaller number of wheels than the second guide wheel sets, and the axle of the first guide wheel sets is shorter than the axle of the second guide wheel sets, the guide sections and their walls comprise apertures which are in register on both guide sections and are so disposed that the first and second guide wheel sets are removable through said aperture; the system additionally including a cover by which the aperture is partly coverable, whereby when the cover constitutes a partial covering of the aperture, the wheels in the extreme positions on the axle of the second guide wheel sets rest against said cover as the second guide wheel sets are being moved past the aperture and when the first guide wheel sets are in register with the aperture, the first guide wheel sets can be removed through the aperture without hindrance from the cover, for turning the sliding element.

12. The system of claim 11, wherein the first guide wheel sets include at least two wheels and the second guide wheel sets include at least one wheel more than the first guide wheel sets.

13. The system of claim 12, wherein the cover is formed of elastic material, and includes holding members for securing the cover over the aperture.

* * * * *